US006065228A

United States Patent [19]

Begey et al.

[11] Patent Number: 6,065,228

[45] Date of Patent: May 23, 2000

[54] SPORT BOOT HAVING A SOLE ADAPTABLE TO MULTIPLE STANDARDS

[75] Inventors: Jean-Marie Begey, Cranves-Sales; Christian Merle, Vieugy, both of France

[73] Assignee: Salomon S.A., Metz-Tessy, France

[21] Appl. No.: 09/238,032

[22] Filed: Jan. 27, 1999

[30] Foreign Application Priority Data

Jan. 30, 1998 [FR] France ..... 98 01267

[51] Int. Cl.[7] ..... A43C 13/00; A43B 5/04

[52] U.S. Cl. ..... 36/15; 36/117.3

[58] Field of Search ..... 36/15, 100, 97, 36/117.3, 115

[56] References Cited

U.S. PATENT DOCUMENTS

| | | | |
|---|---|---|---|
| 3,526,976 | 9/1970 | Jacobs | 36/100 |
| 4,114,295 | 9/1978 | Schaefer | 36/100 |
| 4,351,120 | 9/1982 | Dalebout | 36/15 X |
| 4,982,515 | 1/1991 | Sarter | 36/117.3 |
| 5,214,865 | 6/1993 | Sartor | 36/117.3 |
| 5,293,702 | 3/1994 | Miyoshi et al. | 36/15 X |
| 5,400,527 | 3/1995 | Marega et al. | 36/117.3 |

FOREIGN PATENT DOCUMENTS

| | | |
|---|---|---|
| 2152358 | 7/1994 | Canada . |
| 0167765 | 1/1986 | European Pat. Off. . |
| 0815756 | 1/1998 | European Pat. Off. . |
| 2743700 | 7/1997 | France . |
| 4329186 | 3/1995 | Germany . |
| WO 94/14350 | 7/1994 | WIPO . |
| WO 97/26959 | 7/1997 | WIPO . |

*Primary Examiner*—B. Dayoan
*Attorney, Agent, or Firm*—Greenblum & Bernstein, P.L.C.

[57] ABSTRACT

A sport boot that can be converted to adapt to a variety of sports, especially gliding sports. The sole of the boot is constituted of an irremovable base affixed to the shell, and on which front and rear vertical retention zones are obtained, on the one hand, and of front and rear sole portions that are distinct, interchangeable and complementary to the sole base to which they adapt to constitute the tip and the heel, respectively, and being selected by the user among at least two sets of front and rear sole portions whose profiles and dimensional characteristics are capable of allowing, relative to the front and rear zones for the axial retention of the fixed base and complementarily with the latter, to recontitute and adapt a sole from the same boot, conforming to one binding standard or another.

13 Claims, 4 Drawing Sheets

1
4
3
7
2
8
9

10
17

11
17
17

10 B
17

11 B
17
17

SPORT BOOT HAVING A SOLE ADAPTABLE TO MULTIPLE STANDARDS

BACKGROUND OF THE INVENTION

1. Field of the Invention

The present invention relates to a sport boot that can be converted to adapt to a variety of sports, especially gliding sports.

The above-mentioned type of boot is made from a conventional design, and has an external sole from which extends a shell base that is overlaid by an upper provided with an opening allowing the passage of a user's foot.

The boot is adapted to cooperate with a gliding element, on the one hand, via support surfaces formed at the bottom of the sole and cooperating with corresponding fixed surfaces of the gliding element, or of a binding device of the boot attached on the latter and, on the other hand, via zones for the vertical retention of the boot obtained at the front and rear of its sole or a part of its shell base, according to accepted standards, and adapted to cooperate with fastening members coming from the binding device.

The boot can be adapted, for example, to the alpine skiing, snowboarding, or mountain skiing.

2. Description of Background and Relevant Information

A boot of the aforementioned type is known from European Patent No. 0 167 765, which describes a boot that is capable of being adapted to mountain skiing or to alpine skiing due to the fact that a sole for mountain skiing is fully interchangeable with a sole for alpine skiing, and vice versa, under a rigid shell base provided with studs and in which the user's foot is housed.

According to such a boot design, it is necessary to have two integral soles, in addition to the rigid sole, which itself is provided with a studded sole, and very strong assembly means to guarantee the coherence between these various constituent elements of the boot.

On this last point, it is especially noted that it is on the edges of the removable soles that the retaining members of the ski bindings take support when the boot is used for alpine skiing, and that these edges, particularly in the heel zone of the boot, are blocked with respect to the rigid shell only by a pivoting stirrup located on the dorsal portion of the heel. Since the forces are particularly substantial in this zone, it appears clearly that the shell must be substantially reinforced in the area where it fastens to the pivoting stirrup.

A boot of this type is also known from the French Patent Publication No. 2 743 700, which describes a boot whose front and rear ends have removable binding means, of at least two types of soles, the one being standardized for skiing, and the other having a profile adapted for walking, so as to make them interchangeable and allow skiing with a walking sole from the same shell base, if the ski is provided with a raising cradle, or by adapting a standardized sole, if the ski is not provided with a raising cradle and is, therefore, conventional.

According to a particularity of this boot, the interchangeable soles are made of two distinct, but complementary, parts constituting the heel and the tip, each part defining upper end planes constituting the vertical retention zones adapted to cooperate with the fastening members of the binding device.

This last point clearly shows that, as previously, it is on the edge of the removable sole portions forming the heel and the tip that the members for the axial retention of the ski bindings take support, and that reinforcements are therefore necessary to withstand the particularly substantial forces in this zone, as in the aforementioned boot.

SUMMARY OF THE INVENTION

An object of the present invention is to overcome the various known drawbacks of the prior art and relates, to this end, to a sport boot that is convertible to adapt to various sports, especially gliding sports, of the type having an external sole from which extends a shell base that is overlaid by an upper provided with an opening allowing the passage of the user's foot. The boot is adapted to cooperate with a gliding element (not shown), on the one hand, via support surfaces formed by the bottom of the sole and cooperating with corresponding fixed surfaces of the gliding element (not shown), or of a boot binding device (not shown) attached on the latter and, on the other hand, via zones for the vertical retention of the boot provided at the front and rear of its sole or a part of its shell base, according to established standards, and adapted to cooperate with fastening members (not shown) extending from the binding device.

The sole of the sport boot of the invention includes an irremovable base affixed to the shell, and on which the front and rear vertical retention zones are provided, on the one hand, and of front and rear sole portion that are distinct, interchangeable and complementary to the sole base to which they adapt to form the support surfaces of the boot on the gliding element (not shown), the front and rear sole portion constitating the tip and the heel, respectively, being selected by the user among at least two sets of front and rear sole portion whose profiles and dimensional characteristics are capable of allowing, relative to the front and rear zones for the axial retention of the fixed base and complementarily with the latter, to reconstitute and adapt a sole from the same boot, conforming to a binding standard selected among several standards, depending upon whether the user chooses to practice one gliding sport or another, such as alpine skiing, snowboarding, mountain skiing.

According to the invention, it is clearly seen that the edges of the boot sole, which are integral with the shell or the base of the sole that is affixed thereto, cause the forces exerted on these edges to be distributed over a larger zone, or even the entire shell, and not at a very localized point, as mentioned previously. In fact, according to the invention, only the lower portion of the sole adapted to touch the ground is provided to be removable and interchangeable. This arrangement further allows the use of small sized elements without reinforcement and, therefore, a compact instead of an integral sole.

The present invention also relates to the characteristics which will become apparent along the following description, and which must be considered separately or according to all their possible technical combinations.

BRIEF DESCRIPTION OF DRAWINGS

The following description, provided by way of non-limiting example, will help to better understand how the invention can be embodied, with reference to the annexed drawings, in which.

DETAILED DESCRIPTION OF THE INVENTION

Figure 1:
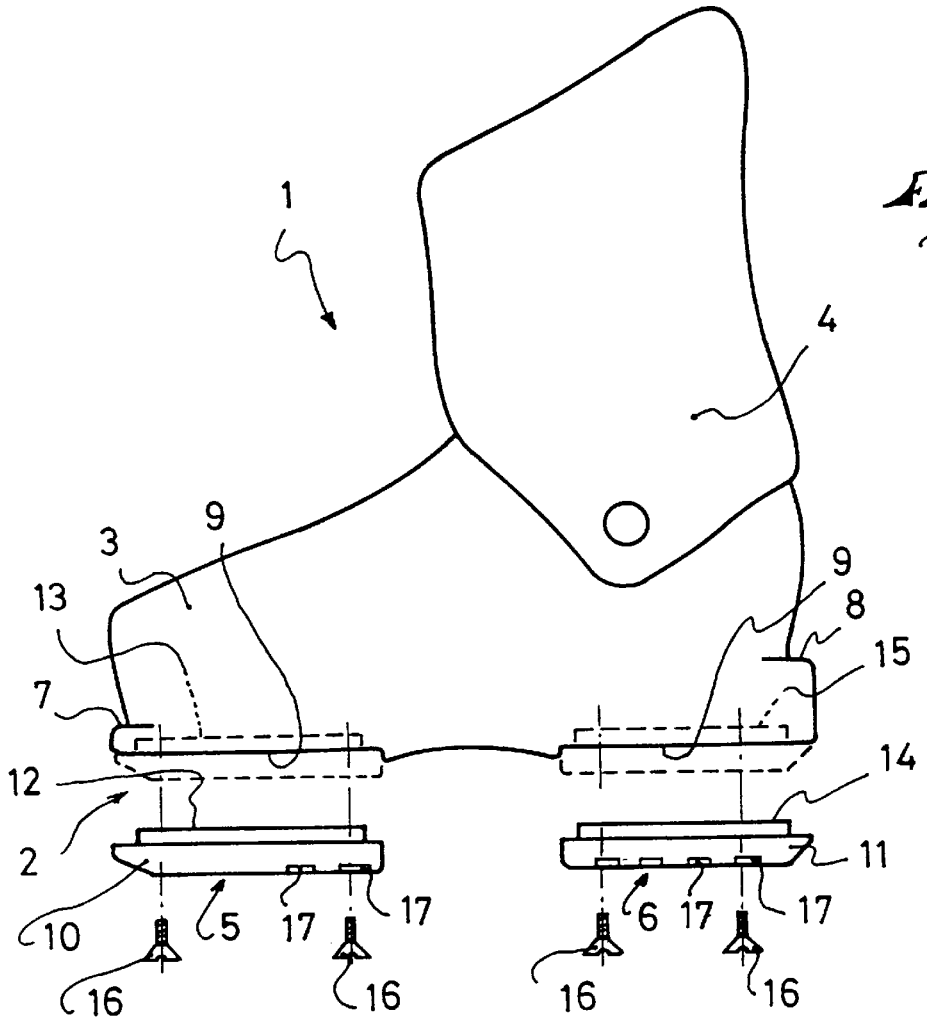
FIG. 1 illustrates a boot in a side elevation view, showing an exploded view of the front and rear sole portions including a tip and a heel, respectively, ready for assembly.

The boot 1 schematically shown in FIG. 1 generally has an external sole 2 from which extends a shell base 3 that is overlaid by an upper 4 provided with an opening allowing the passage of the user's foot. The boot 1 is adapted to cooperate with a gliding element, not shown, on the one hand, via support surfaces 5 and 6 formed by the bottom of the sole 2 and cooperating with corresponding fixed surfaces of the gliding element, not shown, or of a binding device, not shown, of the boot 1 attached on the latter, and on the other hand, via zones 7 and 8 for the vertical retention of the boot 1 provided at the front and rear of its sole 2 or part of its shell base 3, according to established standards, and adapted to cooperate with fastening members, not shown, extending from the binding device.

According to the invention, the sole 2 is constituted of an irremovable base 9 affixed to the shell 3, and on which the vertical retention front 7 and rear 8 zones are provided, on the one hand, and of front 10 and rear 11 sole portions that are distinct, interchangeable, and complementary to the base 9 of the sole 2 to which they adapt to form the support surfaces 5 and 6 of the boot 1 on the gliding element, not shown. The front 10 and rear 11 sole portions constitute the tip and the heel, respectively, and are selected by the user among at least two sets of front and rear sole portions 10, 10A, or 10B and 11, 11A, or 11B whose profiles and dimensional characteristics are capable of allowing, relative to the front 7 and rear 8 zones for the axial retention of the fixed base 9 and complementarily with the latter, to reconstitute and adapt a sole 2 from the same boot 1, conforming to one binding standard or another, depending upon whether the user chooses to practice one gliding sport or another, such as alpine skiing, snowboarding, or mountain skiing.

According to a first example of adaptation of the boot 1, shown in FIGS. 1–6, the front and rear sole portions constituting the tip 10 and heel 11 are adapted to alpine skiing whose corresponding standard is ISO 5355.

The front and rear sole portions constituting the tip 10 and the heel 11 are made removable via positioning structure 12, 13, and 14, 15, and anchoring points or areas obtained in the sole portion 2 forming the fixed base 9, allowing their positioning on the latter, by means of equally removable assembly elements 16.

Figure 2A:
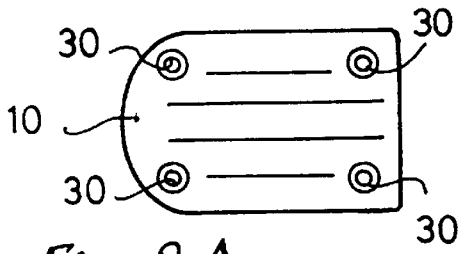
FIGS. 2A and 2B are internal and external views, respectively, of a sole tip to be attached, and which is standardized to conform to the alpine skiing standards.
Figure 3A:
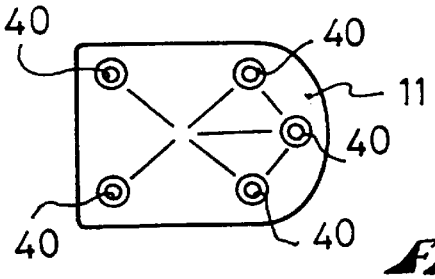
FIGS. 3A and 3B are internal and external views, respectively, of a heel that is standardized to also conform to the alpine skiing standards and adapted to be associated with the tips of FIGS. 2A and 2B.
Figure 2B:
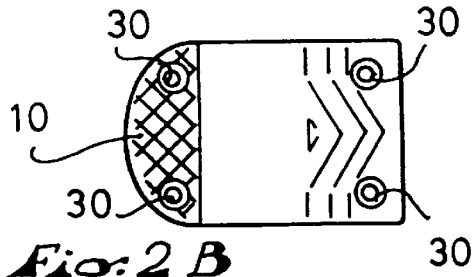
Figure 3B:
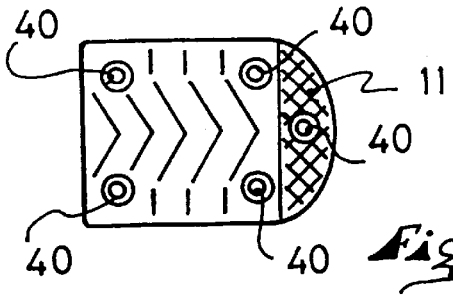
Figures 4, 5, 6, 7, 8:
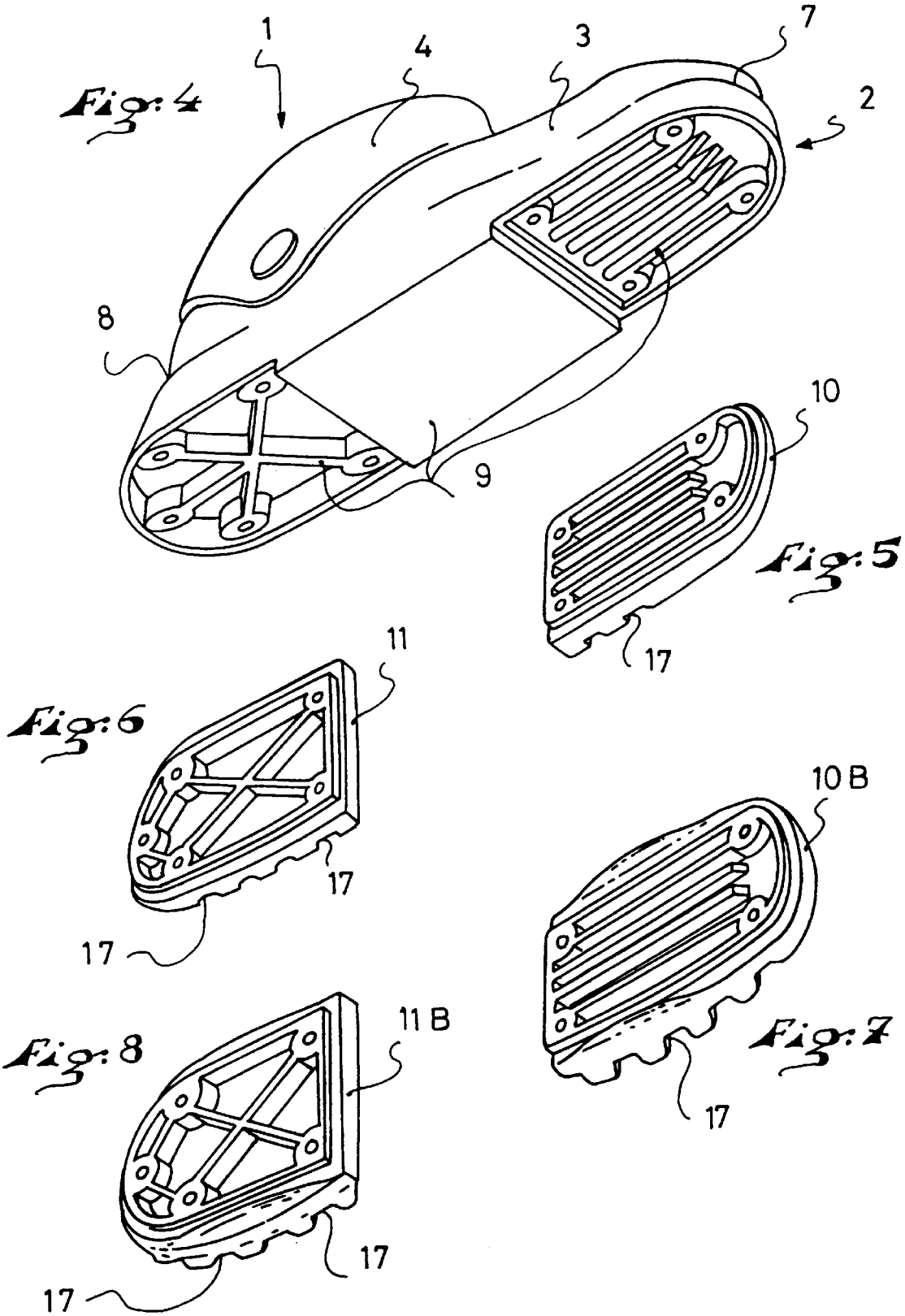
FIG. 4 is a bottom perspective view of a boot according to FIG. 1, before the assembly of a tip and a heel to mount complementarily to the sole base.
FIGS. 5 and 6 illustrate a tip and a heel, respectively, to be mounted on the sole base of FIG. 4, conforming to the alpine skiing standards.
FIGS. 7 and 8 illustrate a tip and a heel, respectively, to be mounted on the sole base of FIG. 4, conforming to the mountain skiing standards.
Figure 8A:
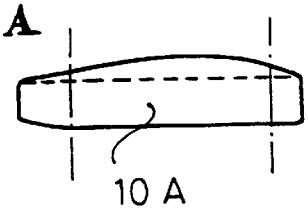
FIGS. 8A and 8B illustrate a side elevation view and an internal view, respectively, of a sole tip to be attached and conforming to the snowboarding standards.
Figure 9A:
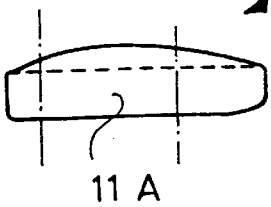
FIGS. 9A and 9B illustrate a side elevation view and an internal view, respectively, of a heel to be attached and also conforming to the snowboarding standards.
Figure 8B:
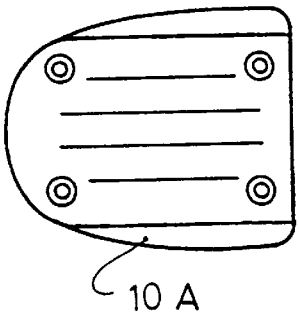
Figure 9B:
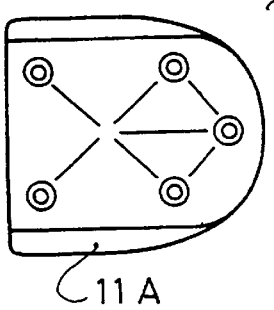
Figure 10A:
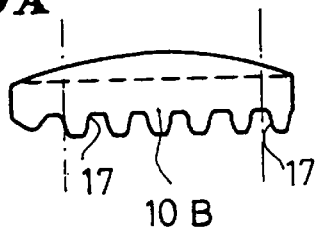
FIGS. 10A and 10B illustrate a side elevation view and an internal view, respectively, of a tip to be attached and conforming to the mountain skiing standards.
Figure 11A:
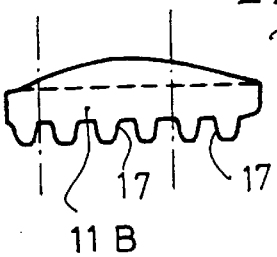
FIGS. 11A and 11B illustrate a side elevation view and an internal view, respectively, of a heel to be attached and also conforming to the mountain skiing standards, to be associated with the tip of FIGS. 10A and 10B.
Figure 10B:
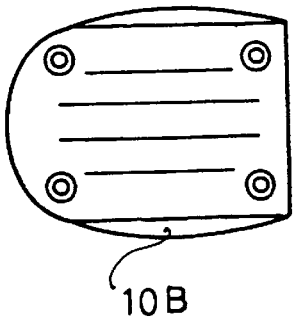
Figure 11B:
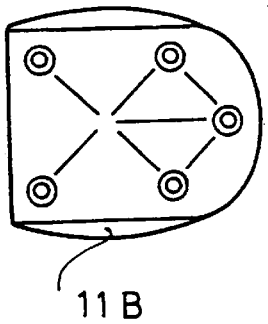
Figure 12:
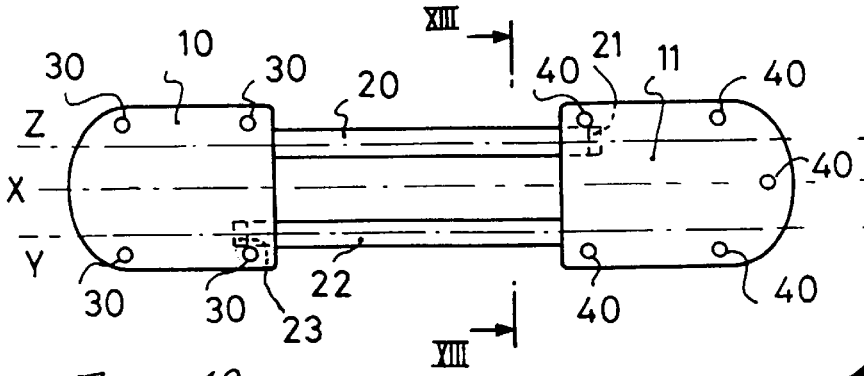
FIG. 12 is a plan view of a tip and heel assembly provided with connecting means forming polarizing elements, i.e., elements having an arrangement to prevent improper connection, and adapted, for example, to alpine skiing.
Figure 13:
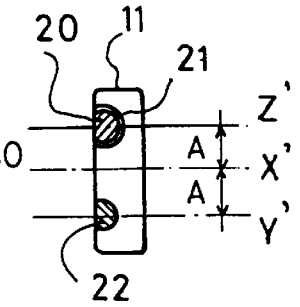
FIG. 13 is a transverse cross-sectional view taken along the line XIII—XIII of FIG. 12.
Figure 14:
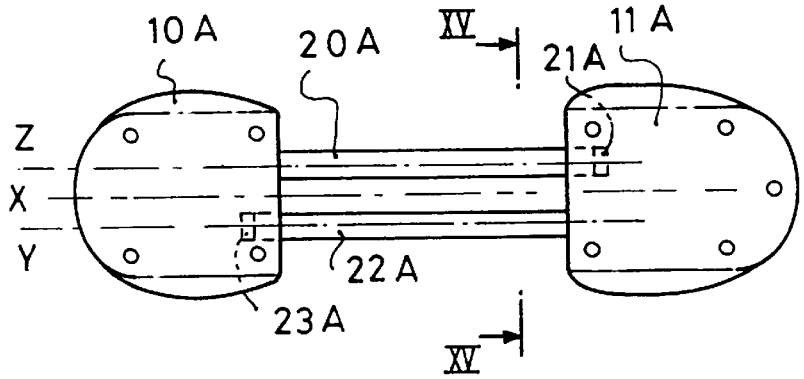
FIG. 14 is a plan view of a tip and heel assembly provided with a polarizing connecting arrangement and adapted, for example, to snowboarding.
Figure 15:
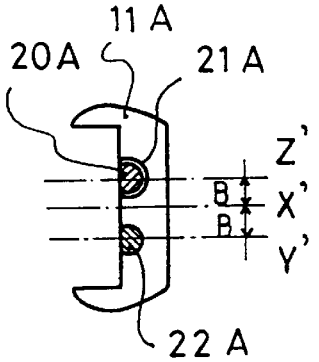
FIG. 15 is a transverse cross-sectional view taken along the line XV—XV of FIG. 14.
Figure 16:
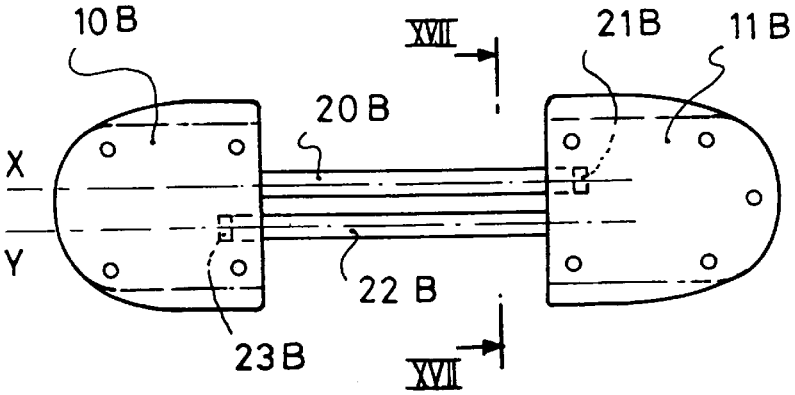
FIG. 16 is a plan view of a tip and heel assembly provided with a polarizing connecting arrangement and adapted, for example, to mountain skiing.
Figure 17:
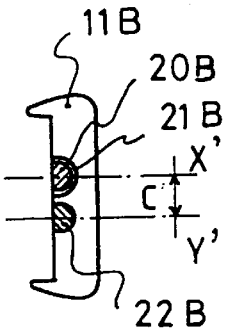
FIG. 17 is a transverse cross-sectional view taken along the line XVII—XVII of FIG. 16.

As shown particularly in FIGS. 2A and 3A, and FIG. 4, in association with FIGS. 5 and 6, the positioning structure 12, 13, and 14, 15 and/or the anchoring points are different depending upon whether it is the front sole portion 10 or tip, or the rear sole portion 11 or the heel, so as to prevent any possibility of inversion.

These means 12, 13, and 14, 15 for positioning the front and rear sole portions 10, 11, on the fixed base 9 of the sole 2 are constituted by complementary nesting zones projecting on the sole portions 10 and 11 and recessed on the base 9.

These figures still show that the anchoring points of the front and rear sole portions 10 and 11 cooperate fixedly with the assembly means, such as the screws 16, and are obtained in a number and geometrical positioning that are different for one with respect to the others, depending upon whether it is the front sole portion 10 or rear sole portion 11, in order to prevent their inversion.

Thus, the front sole portions 10 are bored with four holes 30 arranged substantially rectangularly and cooperating with corresponding holes of the sole base 9 in order to be attached thereto by the four screws 16, whereas the heel 11 is crossed by five holes 40 arranged according to a different geometry and also aligned with corresponding holes of the base 9 in order to be attached thereto by five screws 16

According to another characteristic of the invention, it must be noted that the positioning structure and the anchoring points of the front and rear sole portions 10 and 11 with respect to the base 9 of the sole 2 are different from one another, but are identical for all the front sole portions 10, 10A, 10B, and all the rear sole portions 11, 11A, 11B, conforming to different standards and associated by sets, made available to the user so that the user can adapt the same boot to the sport to be practiced.

FIGS. 8A, 8B and 9A, 9B show front sole portions 10A and rear sole portion 11A, respectively, conforming to the ISO 11634 standard for snowboarding, whereas FIGS. 10A, 10B, and 11A, 11B show front sole portions 10B and rear sole portions 11B, respectively, conforming to the ISO 9523 standard for mountain or touring skiing.

It is noted that the main difference between the front sole portions 10, 10A, 10B and the rear sole portions 11, 11A, 11B, depending upon whether it relates to alpine skiing, snowboarding or mountain skiing, lies in the fact that the notches 17 obtained on their support surfaces are in a different number, and have a shape that also offers a different profile depending on the sport.

Regarding the dimensions of the front and rear sole portions, depending on the selected sport, it will be seen later that their dimensions can be substantially identical for all the front sole portions, and for all the rear sole portions for the common zones as imposed by the standards.

According to another characteristic of the invention, each set of front 10, 10A, or 10B, and rear 11, 11A, or 11B sole portions conforming to a given standard, is provided with polarizing elements, predetermined specifically according to this standard, and which are constituted by connection means arranged between the front sole portion 10, 10A, or 10B, and the rear sole portion 11, 11A, or 11B, and cooperating with one and the other, respectively, in a complementary and reversible manner.

According to a particular example of embodiment shown in FIGS. 12–17, the connection means of the front and rear sole portions, serving as polarizing elements, i.e., elements for preventing the connection to be made wrongly, are constituted by a connecting rod 20, 20A, or 20B, affixed to the front sole portion 10, 10*a*, or 10B, and extending therefrom toward the rear sole portion 11, 11A, or 11B, to cooperate with a corresponding housing 21, 21A, or 21B, in which it is nested. They are also constituted by a second connecting rod 22, 22A, or 22B, reversely affixed to the rear sole portion 11, 11A, or 11B, and extending therefrom toward the front sole portion 10, 10A, or 10B to cooperate with a corresponding housing 23, 23A, or 23B in which it becomes nested, in a head to foot manner, the spacing distance A+A, B+B, or C+C of the parallel longitudinal axes zz' or yy' of each rod 20, 20A, 20B and 22, 22A, or 22B and the positioning of these axes, with respect to the axis of symmetry xx' of the assembly, being different depending upon whether it relates to front 10, 10A, or 10B and rear 11, 11A, or 11B sole portions conforming to one standard or another, preventing any mixing of sole portions conforming to one standard to be mixed with sole portions conforming to another standard.

Thus, the value of A is greater than the value of B and the value of C, while the value of C is greater than the value of B.

As mentioned hereinabove, the dimensions of the front 10, 10A, or 10B and rear 11, 11A, or 11B sole portions, for each series of front sole portions and each series of rear sole portions intended for different sports, will be substantialy identical for the common zones imposed by the standards.

Indeed, referring to the ISO 5355 standard regarding ski boots for alpine skiing, one notes that the width of the rear heel must be 69±2 mm. i.e., comprised between 67 and 71 mm, while the vertical retention zone must be 6 mm, the width of the same zone must be 50 mm, and its radius must be 37±4 mm.

With respect to a snowboard boot, and more specifically its zone of junction with the ski bindings, established according to the ISO 11634 standard, one sees that the width of the heel must be 75±5 mm, i.e., comprised between 70 and 80 mm, that the vertical retention zone must be 6 mm, that the width thereof must be 50 mm, and that its radius must be 37±4 mm to 5 mm.

Finally, with respect to mountain ski boots, the zones of junction with the ski bindings, according to the ISO 9523 standard, must be 80 mm with a tolerance of 0 to −15 mm, i.e., comprised between 65 and 80 mm, with respect to the heel, the vertical retention zone must also be 6 mm, and its width 50 mm, whereas the radius of the same retention zone must be 37 mm, with a tolerance of 0 to −3 mm.

It must also be noted that, depending upon whether it relates to a boot for alpine skiing, snowboarding, or mountain skiing, the height between the vertical retention zone and the support plane on the gliding board must be 30±1 mm, 34±3 mm, 32±3 mm, respectively, according to the aforementioned standards.

A study of these different dimensioning parameters shows that it is possible to find a compromise for each of these dimensions, by remaining within the tolerances imposed for each by the various standards, thereby allowing an identical dimensioning for all these standards.

In this way, the differentiation between the heels and the tips lies mostly in the size of their notches and of their thickness, and in the very fact that it relates to a front or rear sole portion, depending upon the sport to be practiced.

It must also be noted that the middle soles, according to their corresponding standards, can have more or less substantial lateral edges which rise at least partially on the flanks of the sole, and can be obtained with smooth, partially smooth or studded walking surfaces.

The instant application is based upon French Patent Application No. 98 01267, filed on Jan. 30, 1998, the disclosure of which is hereby incorporated by reference thereto in its entirety and the priority of which is hereby claimed under 35 USC 119.

What is claimed is:

1. A sports boot that is convertible to adapt to use with a plurality of gliding devices for practicing a plurality of gliding sports, said boot comprising:

an external sole;

a shell base extending upwardly from said sole;

an upper extending upwardly from said shell base, said upper including an opening for allowing passage of a foot of a wearer of the boot;

said external sole including:

an irremovable base affixed to said shell base, said base having front and rear vertical retention zones adapted to cooperate with fastening members of a boot binding device;

a plurality of sets of front and rear sole portions adapted to be secured to said sole base, each set of said plurality of sets forming bottom support surfaces of the boot on any of the gliding devices, each set of said plurality of sets being distinct, interchangeable, and complementary to said sole base;

said front and rear sole portions of each of said plurality of sets constituting a front end and a rear end, respectively, of said external sole;

said front and rear sole portions of each of said plurality of sets having shapes and sizes capable of conforming, with respect to said front and rear retention zones of said irremovable base, and together with said irremovable base, said external sole to a binding standard selected from among a plurality of binding standards, corresponding to one of said gliding sports.

2. A sports boot according to claim 1, wherein:

said gliding sports include alpine skiing, snowboarding, and touring skiing, and said plurality of binding standards are ISO 5355, ISO 11634, and ISO 9523, respectively.

3. A sports boot according to claim 1, wherein:

said front and rear sole portions of said plurality of sets include positioning structure and said sole base includes respective anchoring areas, said positioning structure of said front and rear sole portions adapted to position said front and rear sole portions on said anchoring areas of said sole base;

removable assembly elements secure said front and rear sole portions to said sole base.

4. A sports boot according to claim 3, wherein:

said removable assembly elements are screws.

5. A sports boot according to claim 3, wherein:

to prevent inversion of said front and rear sole portions, at least one of the following relationships exists:

(a) said positioning structure of said front sole portion is different from said positioning structure of said rear sole portion; and (b) said anchoring areas at a front of said sole base is different from said anchoring areas at a rear of said sole base.

6. A sports boot according to claim 5, wherein:

said positioning structures of said front and rear sole portions and said anchoring areas of said front and rear of said sole base are constituted by complementary nesting zones, one of said nesting zones projecting and a second of said nesting zones being recessed.

7. A sports boot according to claim 6, wherein:

said nesting zones of said front and rear sole portions project therefrom and said nesting zones of said sole base being recessed therein.

8. A sport boot according to claim 5, wherein:

to prevent inversion of said front and rear sole portions, said assembly elements are provided for said front portions in a number and geometrical positioning that are different than a number and geometrical positioning for said rear portions.

9. A sport boot according to claim 3, wherein:

said positioning structure of the front sole portions of all of said plurality of sets are different from the positioning structure of the rear sole portions of all of said plurality of sets;

the positioning structure of the front sole portions of all of said plurality of sets are identical with respect to each other and the positioning structure of the rear sole portions of all of said plurality of sets are identical with respect to each other, conforming to said plurality of different standards and associated by sets, made available to the user so that the user can convert a single boot to the gliding sport to be practiced.

10. A sport boot according to claim 3, wherein:

each said plurality of sets of front and rear sole portions conform to one of said plurality of standards and is provided with polarizing elements, each of said polarizing elements being specific to a respective one of said plurality of standards, said polarizing elements comprising connection structure arranged between a front sole portion and a rear sole portion and cooperating with one and the other, respectively, in a complementary and reversible manner.

11. A sport boot according to claim 10, wherein:

said connection structure of for each of said sets of front and rear sole portions comprises:

a first connecting rod affixed to a front sole portion, and extending from said front sole portion toward a rear sole portion to cooperate with a corresponding housing in said rear sole portion in which said first connecting rod is nested; and a second connecting rod affixed to a rear sole portion, and extending from said rear sole portion toward a front sole portion to cooperate with a corresponding housing in said front sole portion in which said second connecting rod is nested;

said first and second connecting rods, for each of said sets of front and rear sole portions, extending substantially parallel along respective longitudinal axes and being spaced apart by a different distance corresponding to a respective one of said plurality of standards, to thereby prevent mixing of sole portions conforming to one standard with sole portions conforming to another standard.

12. A sports boot according to claim 1 in combination with said plurality of gliding devices, wherein:

one of said gliding devices is secured to bottom surfaces of a respective pair of said front and rear sole portions of one set of said plurality of sets of front and rear sole portions.

13. A sports boot that is convertible to adapt to use with a plurality of gliding devices for practicing a plurality of gliding sports, said boot comprising:

an external sole;

a shell base extending upwardly from said sole;

an upper extending upwardly from said shell base, said upper including an opening for allowing passage of a foot of a wearer of the boot;

said external sole including:

an irremovable base affixed to said shell base, said base having front and rear vertical retention zones adapted to cooperate with fastening members of a boot binding device;

a plurality of sets of front and rear sole portions adapted to be secured to said sole base, each set of said plurality of sets forming bottom support surfaces of the boot on any of the gliding devices, each set of said plurality of sets being distinct, interchangeable, and complementary to said sole base;

said front and rear sole portions of each of said plurality of sets having shapes and sizes capable of conforming, with respect to said front and rear retention zones of said irremovable base, and together with said irremovable base, said external sole to a binding standard selected from among a plurality of binding standards, corresponding to one of said gliding sports; and means for preventing inversion of said front and rear sole portions of any of said plurality of sets of front and rear sole portions.

* * * * *